US006595719B1

(12) United States Patent
Ohseki et al.

(10) Patent No.: US 6,595,719 B1
(45) Date of Patent: Jul. 22, 2003

(54) SCREED DEVICE IN A ROAD-PAVING VEHICLE SUCH AS ASPHALT FINISHER

(75) Inventors: Masayuki Ohseki, Ohbu (JP); Kouji Tameike, Ohbu (JP); Akishi Ogura, Ohbu (JP)

(73) Assignee: Sumitomo (Shi) Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/570,956

(22) Filed: May 15, 2000

(30) Foreign Application Priority Data

Jun. 15, 1999 (JP) ..... 11-168175

(51) Int. Cl.[7] ..... E01C 19/22
(52) U.S. Cl. ..... 404/118
(58) Field of Search ..... 404/102, 104, 404/118, 114, 98, 84.01

(56) References Cited

U.S. PATENT DOCUMENTS 2,945,427 A * 7/1960 Gerk ..... 404/118
4,068,969 A * 1/1978 Beach et al. ..... 404/98
4,272,213 A * 6/1981 McGovarin ..... 404/118
4,345,852 A * 8/1982 Goto et al. ..... 404/114
4,379,653 A * 4/1983 Brown ..... 404/118
4,470,783 A * 9/1984 Friebel et al. ..... 425/62
4,678,365 A * 7/1987 Ban et al. ..... 404/118
4,682,908 A * 7/1987 Domenighetti ..... 404/84
4,702,642 A * 10/1987 Musil ..... 404/118
4,828,428 A * 5/1989 Anderson ..... 404/75
5,344,254 A * 9/1994 Sartain ..... 404/104
5,484,227 A * 1/1996 Ikeda et al. ..... 404/84.1
5,568,992 A * 10/1996 Grembowicz et al. ..... 404/101
5,735,634 A * 4/1998 Ulrich et al. ..... 404/102
5,863,149 A * 1/1999 Gustin ..... 404/104
5,924,819 A * 7/1999 Breidenbach ..... 404/96
6,019,544 A * 2/2000 Emerson et al. ..... 404/104

* cited by examiner

*Primary Examiner*—Thomas B. Will
*Assistant Examiner*—Raymond W. Addie
(74) *Attorney, Agent, or Firm*—Fattibene & Fattibene; Arthur T. Fattibene; Paul A. Fattibene

(57) ABSTRACT

A screed device in a road-paving vehicle such as an asphalt finisher, enabling the width of pavement to be steplessly changed up to about three times the width of the main screed through a simple operation. The screed device is so constituted that a pair of extensible screeds 15, 16 having a width nearly equal to the width of a main screed 7 are arranged back and forth in the direction of progress of the main screed, wherein supports 27, 28 are allowed to move in the direction of width of pavement being supported by support portions 23, 24 provided on both sides at the rear upper portions of the main screed 7, said extensible screeds 15, 16 are supported by said supports 27, 28 so as to be freely moved in the direction of width of pavement, and the extensible screeds 15, 16 are moved by the feeding devices such as hydraulic cylinders in the directions of width of pavement but opposite to each other from the rear positions of the main screed 7.

16 Claims, 12 Drawing Sheets

SCREED DEVICE IN A ROAD-PAVING VEHICLE SUCH AS ASPHALT FINISHER

BACKGROUND OF THE INVENTION

1. Field of the Invention

The present invention is concerned with a road-paving vehicle such as asphalt finisher, repaver or remixer which paves the road with a composite material. More specifically, the invention relates to a screed device in a road-paving vehicle such as asphalt finisher equipped with an extensible screed capable of extending the paving width to about three times as large as the width of a main screed.

2. Prior Art

Referring to FIG. 8, an asphalt finisher 1 is equipped with a hopper 2 for receiving composite material from a dump truck, and a conveyer-bar-feeder 3 for conveying the composite material in the hopper 2 to the rear side (toward the front in the drawing). The composite material conveyed to the rear side by the conveyer-bar-feeder 3 falls on the road and is conveyed in the direction of width of pavement by a screw spreader 4 installed at the rear part of the main body of the asphalt finisher 1. At the back of the screw spreader 4, the composite material is paved by a screed device 6 coupled by screed arms 5 to the main body of the asphalt finisher 1.

According to the conventional screed device 6 capable of changing the width of pavement, a main screed 7 is provided, at the back or in front thereof, with extensible screeds 8, 8 having a width of about one-half the width of the main screed 7 on the right and left sides, respectively, and these extensible screeds 8, 8 are moved in the directions of width of pavement but opposite to each other by the feeding or extending devices such as hydraulic cylinders or threaded rods that are not shown in order to extend the width of pavement.

During the execution of works, the screed arms 5 move up and down causing the paving angle to change due to the holding amount of the composite material or due to various factors, and the height of the rear end of the lower surface of the main screed 7 becomes no longer in agreement with the height of the rear end of the lower surface of the extensible screeds 8. Accordingly, stripes are formed on the paved surface 9 (FIG. 9) due to a step between the main screed 7 and the extensible screeds 8. To prevent this, the extensible screeds 8 are moved up or down relative to the main screed 7, or the step is adjusted between the main screed 7 and the extensible screeds 8 depending upon a change in the paving angle, so that the rear end of the lower surface of the main screed 7 and the rear end of the lower surface of the extensible screeds 8 acquire the same height from the paved road surface 10.

The operation for paving the composite material can be finished within a shortened period of time if the total width of the screed device 6 is increased to extend a range of pavement. In order for the asphalt finisher to be transported by using a truck, however, the minimum width of the screed device 6 (nearly the same as the main screed width L (FIG. 8)) is limited to be not wider than the width of the rear body of the truck. With the constitution shown in FIG. 8, therefore, the range L max of pavement is smaller than two times the width L of the main screed at the greatest. In order to execute the pavement maintaining a range which is in excess of two times width L of the main screed, therefore, it becomes necessary to attach extension screeds 12, 12 (FIG. 11) to the outer ends of the extensible screeds 8, 8 by using bolts or by utilizing hinges, or it becomes necessary as shown in FIG. 10 to provide extensible screeds 11, 11 that can be extended and contracted by the feeding or extending devices such as hydraulic cylinders that are not shown at the back on in front of the extensible screeds 8, 8 provided at the back or in front of the main screed 7 like a screed apparatus disclosed in Japanese Unexamined Patent Publication (Kokai) No. 102521/1995.

Referring to FIG. 12, furthermore, extensible screeds 13 and 14 having a width nearly equal to the width of the main screed 7 are provided in front and at the back of the main screed 7, and are extended in the directions opposite to each other by the feeder devices such as hydraulic cylinders that are not shown in order to extend the range of pavement to be more than two times the width L of the main screed (FIG. 12).

When the extensible screed 11 is provided at the back or in front of the extensible screed 8. of FIG. 10 as shown in FIG. 13, steps must be adjusted so that the rear end of the lower surface of the extensible screed 8 and the rear end of the lower surface of the extensible screed 11 acquire the same height from the paved road surface 10 and, hence, the adjustment must be effected at a total of four places on the right side and the left side. The operation for adjusting the steps requires a considerable time, laborious work and a high degree of skill.

Next, when the extension screeds 12, 12 are attached by bolts to the outer ends of the extensible screeds 8, 8 as shown in FIG. 11, the extension screeds 12 become heavy, and considerable work and time are required for the attachment and detachment before executing the work and before the transportation. Further, a skill is required for adjusting the lower surfaces of the extension screeds 8 to be in match with the lower surfaces of the extension screeds 12.

It was described above that the paving angle of the screed device changes depending upon the holding amount of the composite material. However, the paving angle of the screed device is further affected by the holding amount of the composite material in front of the main screed 7. A change in the paving angle of the screed device results in a change in the thickness of pavement. To execute the pavement maintaining a predetermined thickness, therefore, the paving angle must be maintained as constant as possible during the execution of works. In the case of the screed device shown in FIG. 12, however, the holding amount of the composite material in front of the main screed 7 changes depending upon the amount of extension of the extensible screed 13 in front of the main screed 7. Therefore, the paving angle of the screed device is not maintained constant, making it difficult to execute the pavement maintaining the predetermined thickness.

In order to solve the above-mentioned problems, there has been proposed a screed device as taught in Japanese Patent Application No. 155974/1998 (referred to as prior application) (see FIG. 14) filed by the present applicant, according to which extensible screeds 15, 16 having a width nearly the same as the width of the main screed 7 are arranged in a pair back and forth at the back of the main screed 7, holes that are not shown are perforated in instruction arms 17, 18 protruding from both sides at the rear upper portions of the main screed 7, guide shafts 19 and 20 are slidably supported thereby, both ends of the guide shafts 19 and 20 are secured to both ends of the extensible screeds 15 and 16, feeding or extending devices such as hydraulic cylinders that are not shown are provided at the upper portions of the main screed 7 in the directions opposite to each other, and the extensible screeds 15 and 16 are moved by the feeding or extending devices from the rear positions of the main screed in the directions of pavement but opposite to each other, in order to extend the range of pavement to be about three times as large as the width L of the main screed.

In order to broaden the range of pavement even by a small amount, however, the width of the instruction arms 17 and 18 must be narrowed, whereby the width for supporting the guide shafts 19, 20 becomes narrow making it difficult to maintain rigidity of the screed device. In executing the works, therefore, both ends of the extensible screeds 15, 16 jump up from the paved surface due to the reaction, and the thickness of pavement does not become constant in the direction of width of pavement.

Referring to FIG. 15, the composite material sent in the direction of width of pavement by the screw spreader 4 is placed in front of the main screed 7 and the extensible screeds 15, 16 as the asphalt finisher 1 proceeds. However, the extensible screeds 15, 16 located behind the main screed 7 hold more composite material, and most of the composite material stays thereon.

The asphalt finisher 1 proceeds holding large amounts of the composite material and, hence, requires a large driving force (engine output) consuming fuel in an increased amount. Further, since the extensible screed 16 is behind the extensible screed 15, resistance due to the holding amount of the synthetic material differs depending on the right side and the left side, and it becomes difficult for the asphalt finisher 1 to proceed straight.

Further, the composite material that is staying is cooled and is solidified, and is discarded after the end of the paving work and is thus wasted. Further, as the composite material 21 that is cooled and solidified falls on the paved surface 9, there develops inconvenience 22 called "dragging holes" on the paved surface requiring additional time for the repair work, which becomes a burden for the workers (FIGS. 16(*a*) and 16(*b*)).

SUMMARY OF THE INVENTION

It is therefore an object of the present invention to provide a screed device in a road-paving vehicle such as asphalt finisher, capable of steplessly changing the width of pavement up to about three times the width of the main screed through a simple operation.

(1) The screed device of the present invention is so constituted that a pair of extendable or extensible screeds 15, 16 having a width or length nearly equal to the width or length of a main screed are arranged back and forth at the back of the main screed 7 in the direction of progress, wherein supports 27, 28 are allowed to move in the direction of width of pavement being supported by support portions 23, 24 provided on both sides at the rear upper portions of the main screed 7, said extensible screeds 15, 16 are supported by said supports 27, 28 so as to be freely moved in the direction of width of pavement, and said extensible screeds 15, 16 are moved by the feeding or extending devices such as hydraulic cylinders in the directions of width of pavement but opposite to each other from the rear positions of the main screed 7.

(2) The support portions 23, 24 are supported to move up and down with respect to the main screed 7 by hoist means such as threaded rods 29 to adjust the steps between the extensible screeds 15, 16 that are movable in the direction of width of pavement.

(3) The extensible screeds 15, 16 are divided into upper frames 16*a*, 16*a* and lower frames 15*b*, 16*b*, and the lower frames 15*b*, 16*b* are caused by hoist means 30 such as hydraulic cylinders to move up and down relative to the upper frames 15*a*, 16*a* that move in the direction of pavement thereby to adjust the step between the extensible screeds 15 and 16.

(4) An extensible molding board 32 coupled at its one end to a side arm 31 extending forward in the direction of progress from an outer end of the rear extensible screed 16, is supported by a guide 33 provided on the rear surface of the main screed 7 so as to freely move in the direction of width of pavement along a surface nearly the same as the rear surface of the main screed 7 (front surface of the front extensible screed), thereby to adjust the height of the lower end of the extensible molding board 32, so that the composite material is placed in an amount required for the pavement in front of the rear extensible screed 16.

(5) Extensible molding boards 36, 37 coupled at their ends on one side to side arms 34, 35 extending forward in the direction of progress from the outer ends of the extensible screeds 15, 16, are supported by guides 38, 39 provided on the front surface of the main screed 7 so as to freely move in the direction of width of pavement along a surface nearly the same as the front surface of the main screed 7, thereby to adjust the heights of the lower ends of the extensible molding boards 36, 37, so that the composite materials are placed in amounts required for the pavement in front of the extensible screeds 15, 16.

DESCRIPTION OF THE PREFERRED EMBODIMENTS

Figure 1A:
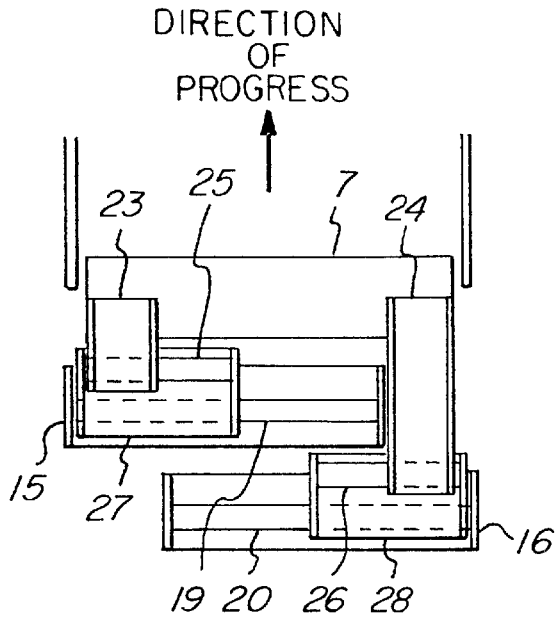
FIG. 1 illustrates a screed device according to the present invention, wherein the diagram (a) illustrates a state where the extensible screeds are contracted and FIG. 1(*b*) illustrates a state where the extensible screeds are extended.

FIG. 1 illustrates a screed device according to the present invention, wherein FIG. 1(*a*) illustrates a state where extensible screeds are contracted and FIG. 1(*b*) illustrates a state where the extensible screeds are extended up to their maximum degree. A pair of extensible screeds 15 and 16 having a width nearly equal to the width of a main screed 7 are arranged back and forth at the back of the main screed 7, and are accommodated within a width nearly equal to the width of the main screed 7 in their contracted state (FIG. 1(*a*)).

Referring to FIG. 1(*b*), holes that are not shown are perforated in support portions 23 and 24 provided on both sides at rear upper portions of the main screed 7, and guide shafts 25 and 26 are supported by those holes to slide in the lateral direction. Both ends of the guide shafts 25 and 26 are secured to both ends of the supports 27 and 28. Further, holes that are not shown are perforated at both ends of the supports 27 and 28, guide shafts 19 and 20 are supported by these holes so as to slide in the lateral direction, and both ends of the guide shafts 19 and 20 are secured to both ends of the extensible screeds 15 and 16.

There are further provided feeding or extending devices such as hydraulic cylinders that are not shown to move the extensible screeds 15 and 16 in the directions of width of pavement but opposite to each other from the rear positions of the main screed 7, in order to extend the range of pavement up to about three times (Lmax) of the width L of the main screed.

Figure 2:
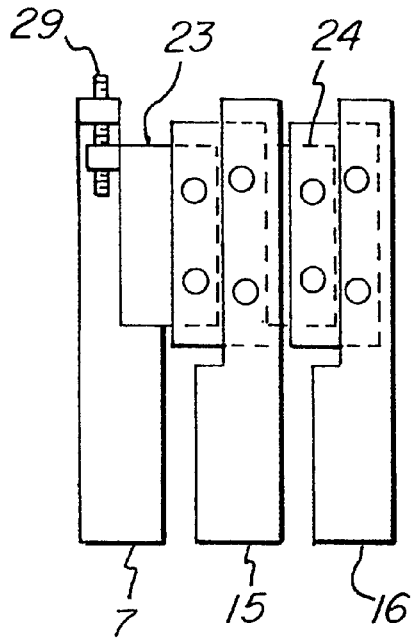
FIG. 2 illustrates a first example of a device for adjusting the step.

Referring to FIG. 2, the support portions 23 and 24 are permitted to move up and down with respect to the main screed 7 by a hoist means 29 such as threaded rod to adjust the steps of the extensible screeds 15 and 16.

Figure 3:
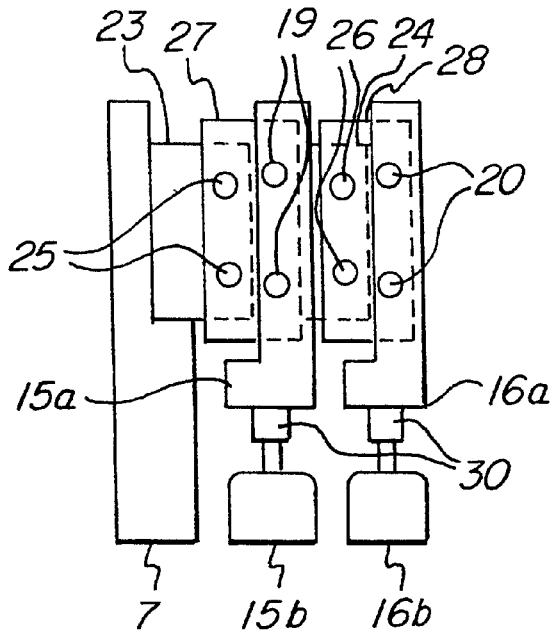
FIG. 3 illustrates a second example of the device for adjusting the step.

FIG. 3 illustrates another method of adjusting the steps, and wherein the extensible screeds 15 and 16 are divided into upper frames 15*a*, 16*a* and lower frames 15*b*, 16*b*, the ends on one side of the hoist means 30 such as hydraulic cylinders are secured to the upper frames 15*a*, 16*a*, and the ends on the other side thereof are secured to the lower frames 15*b*, 16*b*. Due to the hoist means 30, the lower frames 15*b*, 16*b* are allowed to move up and down relative to the upper frames 15*a*, 16*a* that are linked to the main screed 7 through guide shafts 19, 20, supports 27, 28, guide shafts 25, 26, and support portions 23, 24, to make it possible to adjust the steps of the extensible screeds 15 and 16.

As will be understood from FIGS. 1, 2 and 3, the steps are adjusted by adjusting only one portion of each of the extensible screeds 15 and 16 with respect to the main screed 7. The holding amount of the composite material in front of the main screed 7 does not change irrespective of the amount of extension or contraction of the extensible screeds 15 and 16, and the paving angle of the screed device changes little making it possible to execute the paving maintaining a predetermined thickness.

Figure 14:
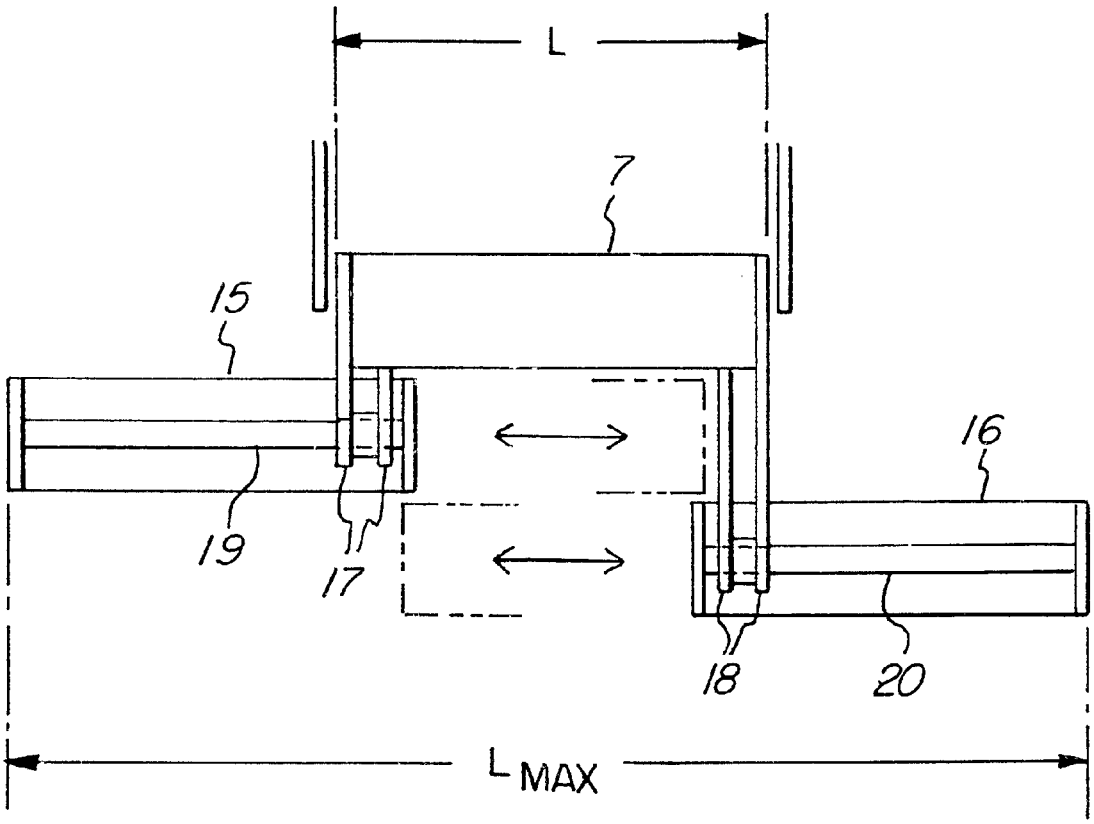
FIG. 14 illustrates a screed device equipped with conventional extensible screeds.
Figure 15:
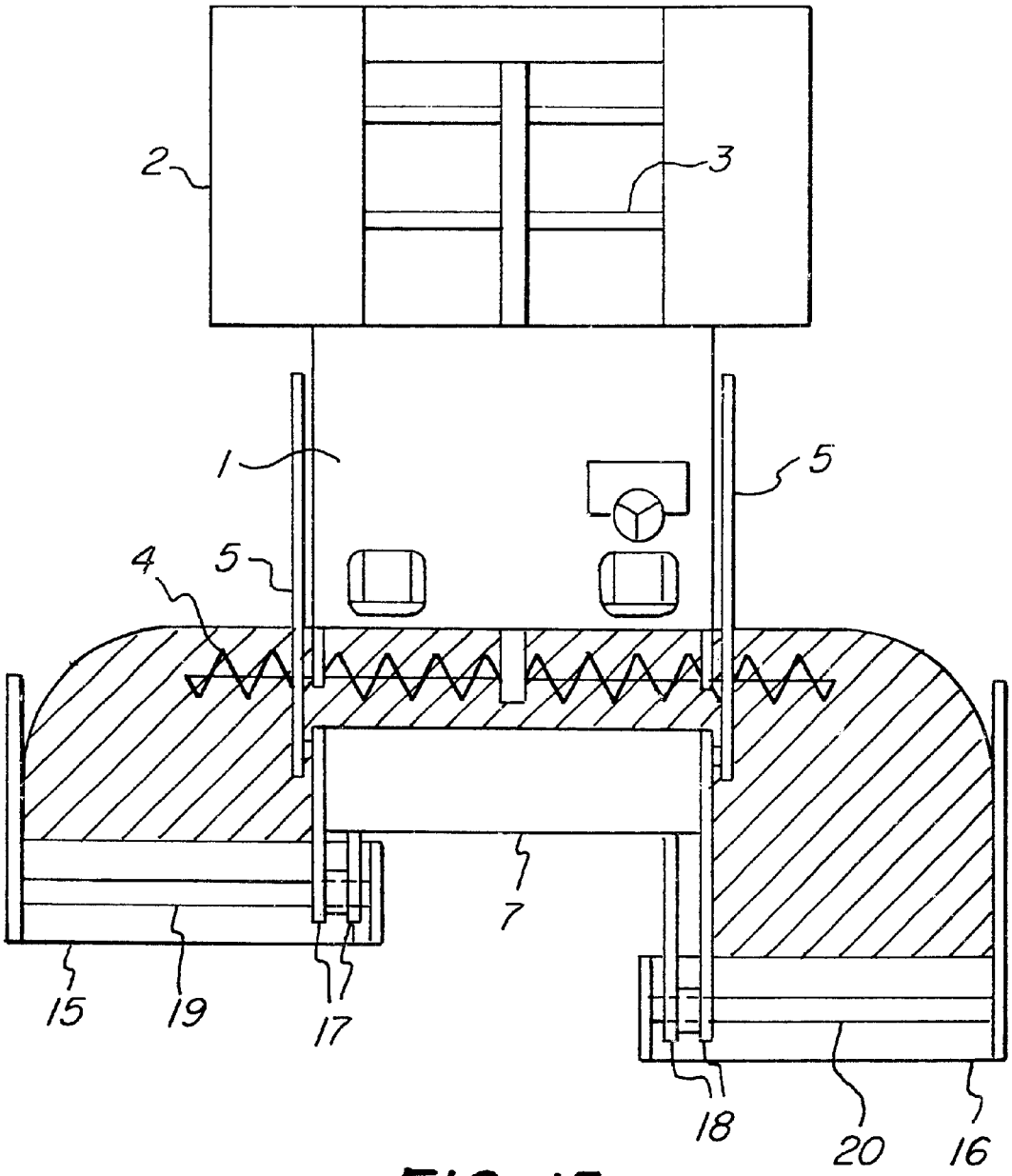
FIG. 15 is a view illustrating a state where the holding amount of the composite material is becoming nonuniform.
Figure 16A:
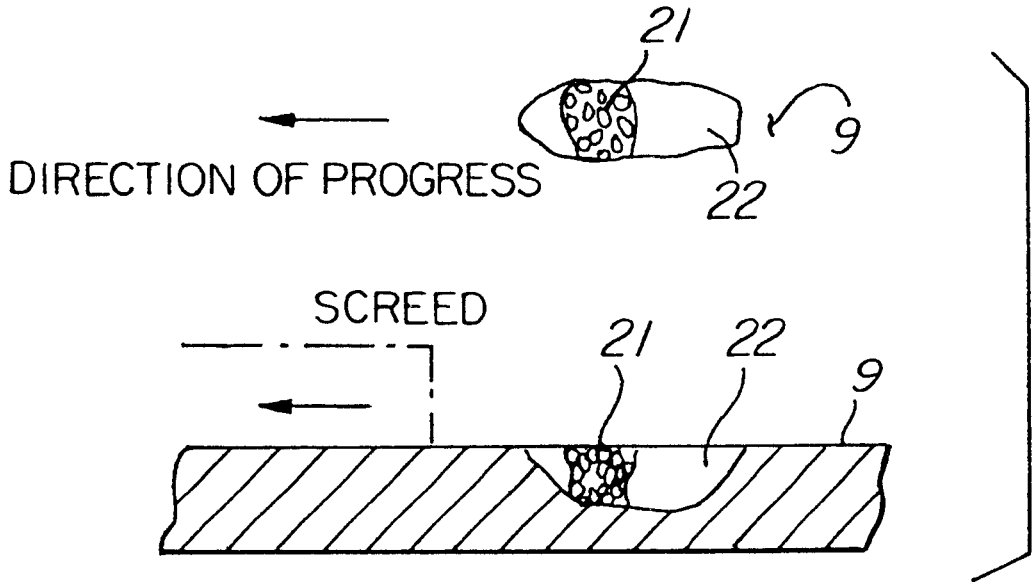
FIGS. 16*a* and 16*b* illustrate the occurrence of dragging holes.
Figure 16B:
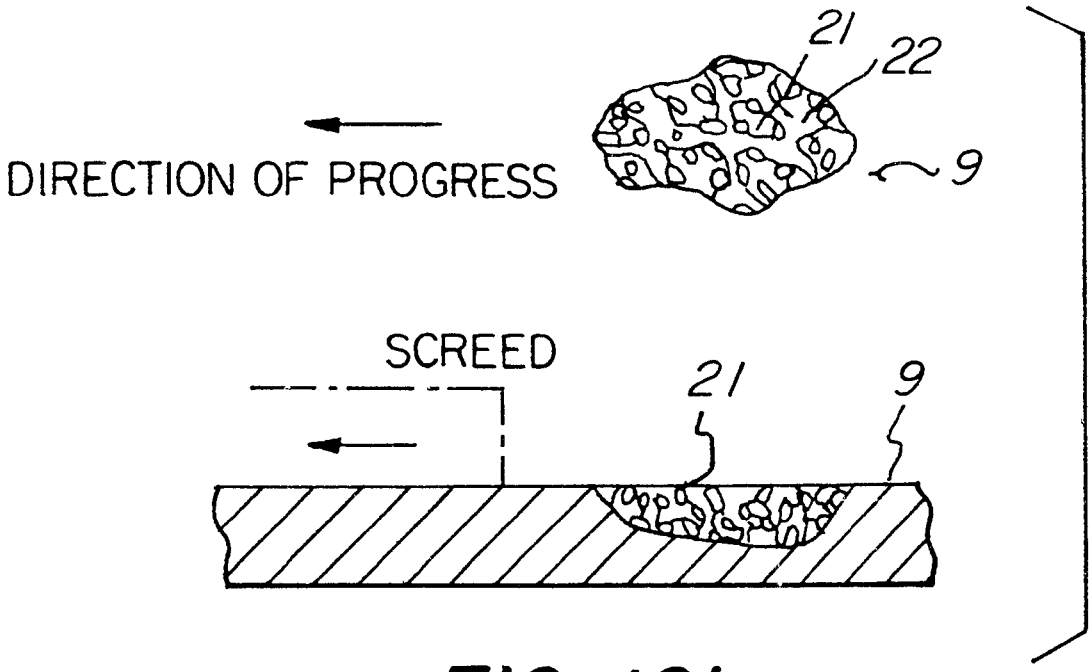

Further, the width for supporting the guide shafts can be broadened compared with that of the screed device of FIG. 14 explained in the prior application of the present applicant, enabling the screed device to exhibit a high rigidity, preventing the extensible screeds 15 and 16 from jumping up over the paved surface due to the reaction during the execution of works, and enabling the thickness of pavement to be uniformalized in the direction of width of pavement.

Figure 4:
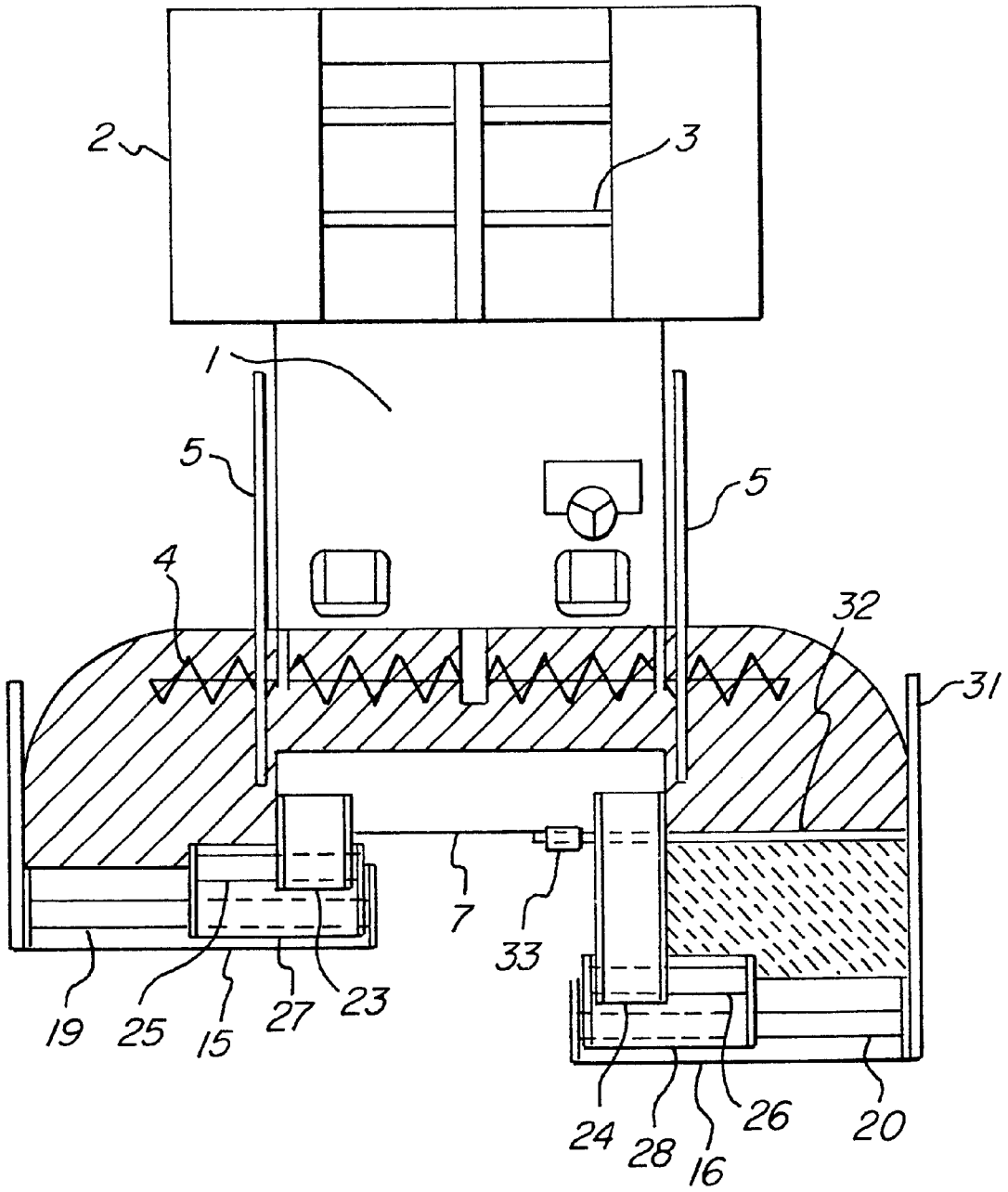
FIG. 4 illustrates a first example of a device for uniformalizing the holding amount of the composite material.

As will be understood from FIG. 4, further, an extensible molding board 32 coupled at its one end to a side arm 31 extending forward (in the direction of progress) from an outer end of the rear extensible screed 16, is supported by a guide 33 provided on the rear surface of the main screed 7 so as to freely move in the direction of width of pavement along a surface nearly the same as the rear surface of the main screed 7 (front surface of the front extensible screed 15), thereby to adjust the height of the lower end of the extensible molding board 32, so that the composite material is placed in an amount required for the pavement in front of the extensible screed 16. Since the front surface of the extensible screed 15 is nearly in flush with the extensible molding board 32, resistance due to the holding amount of the composite material is the same on the right and left sides, and the asphalt finisher 1 proceeds straight.

Figure 5:
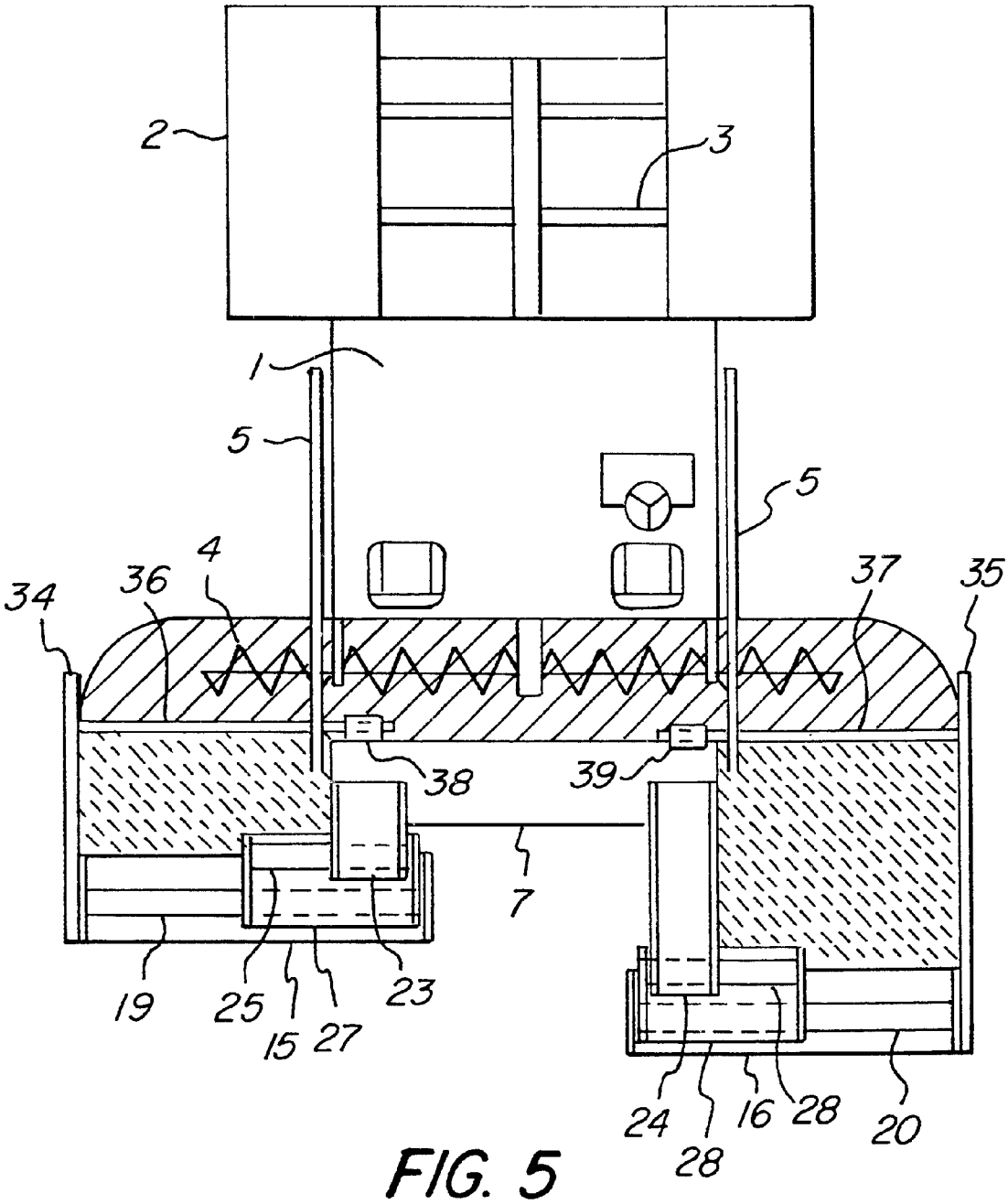
FIG. 5 illustrates a second example of the device for uniformalizing the holding amount of the composite material.

As shown in FIG. 5, further, extensible molding boards 36, 37 coupled at their ends on one side to side arms 34, 35 extending forward from the outer ends of the extensible screeds 15, 16, are supported by guides 38, 39 provided on the front surface of the main screed 7 so as to freely move in the direction of width of pavement along a surface nearly the same as the front surface of the main screed 7, thereby to adjust the heights of the lower ends of the extensible molding boards 36, 37, so that the composite materials are placed in amounts required for the pavement in front of the extensible screeds 15, 16. Accordingly, the composite material is held in a decreased amount in front of the extensible screeds 15 and 16, and no large driving force (engine output) is required, fuel is consumed in decreased amounts, and the composite material does not stay.

Further, the front surface of the main screed 7 is nearly in flush with the extensible molding boards 36 and 37, the resistance due to the holding amount of the composite material becomes the same on the right side and on the left side, and the asphalt finisher 1 proceeds straight.

Figure 6:
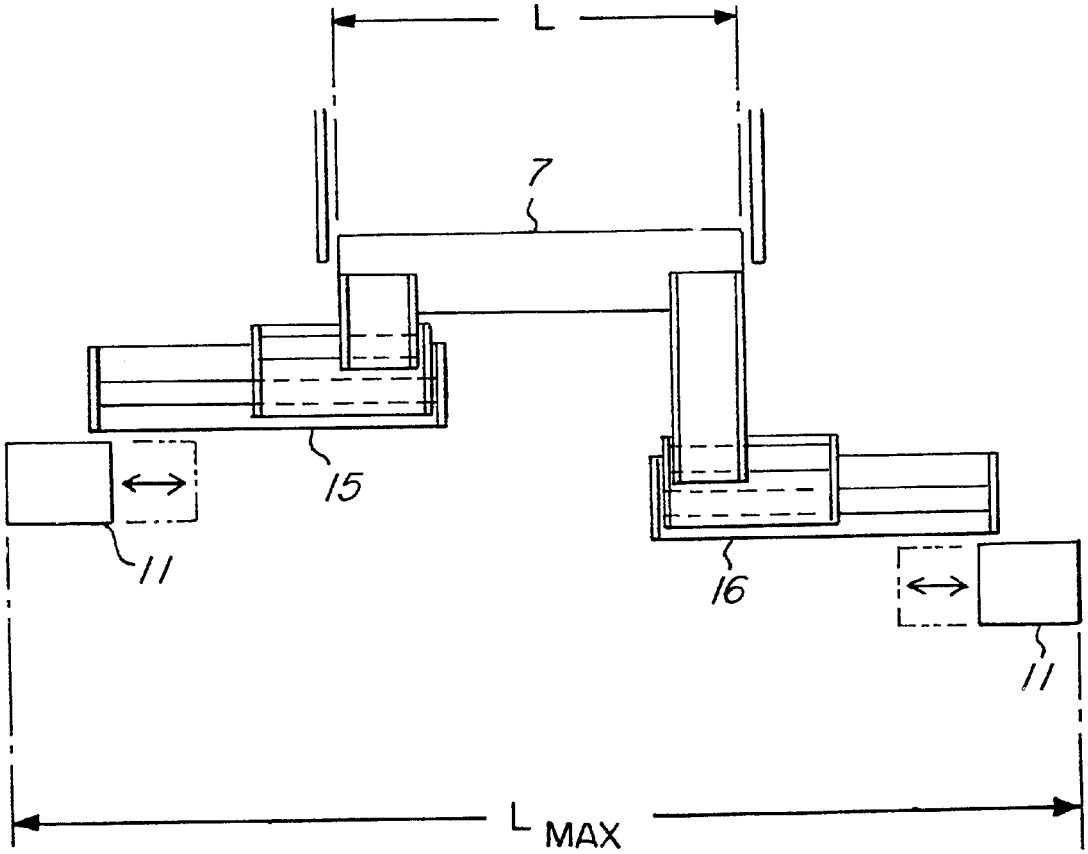
FIG. 6 illustrates an example in which extension screeds are provided at the back or in front of the extensible screeds to move sideways.

Referring to FIG. 6, further, one or more pairs of extension screeds are provided at the back or in front of the extensible screeds 15 and 16, and are moved by the feeding or extending devices such as hydraulic cylinders that are not shown in the directions of width of pavement but opposite to each other from the rear positions or front positions of the extensible screeds 15 and 16 in order to extend the range of pavement up to not less than three times (Lmax) of the width L of the main screed.

Figure 7:
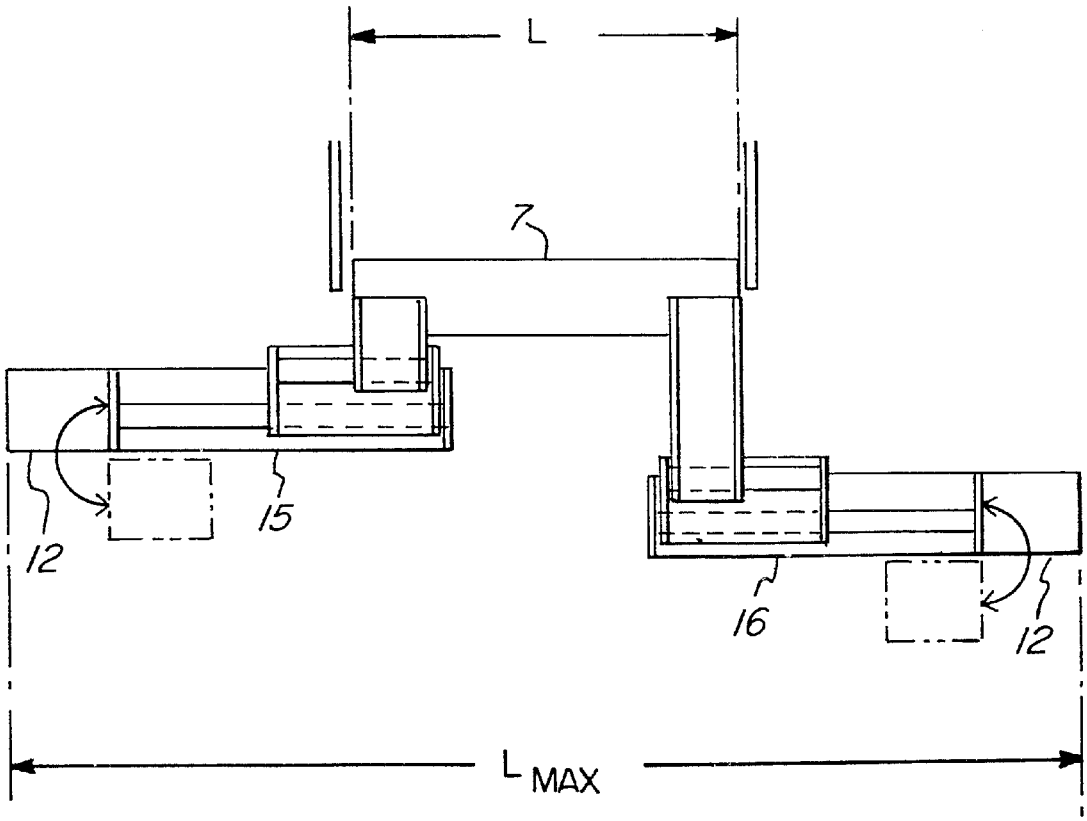
FIG. 7 illustrates an example in which rotary extension screeds are provided at the ends on the outer sides of the extensible screeds.
Figure 8:
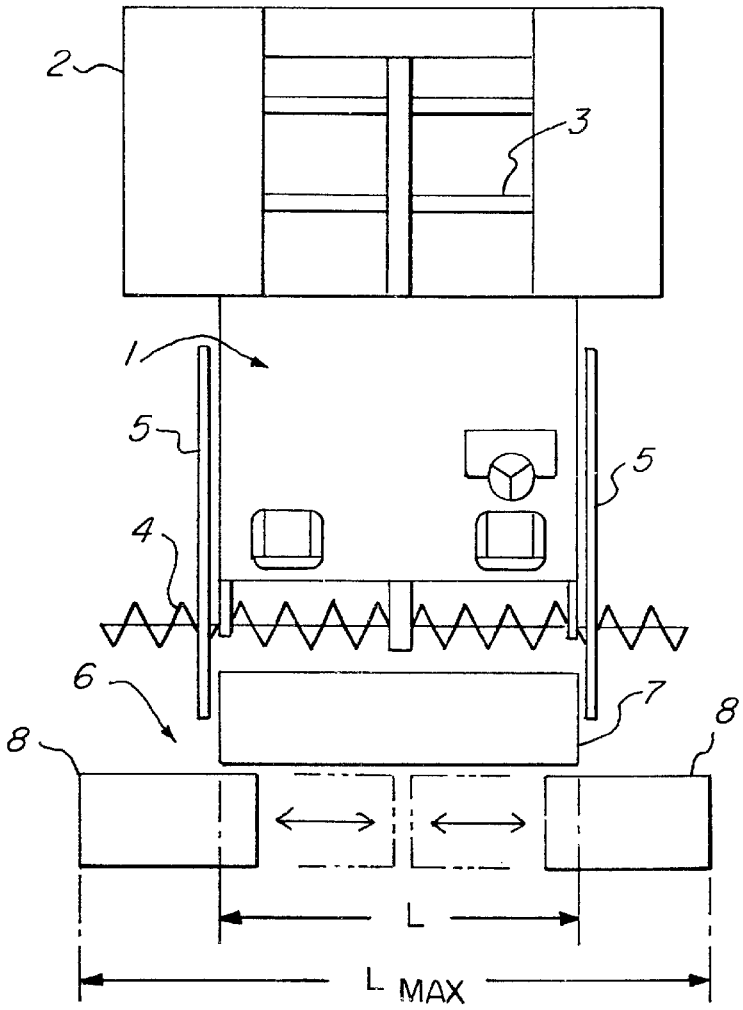
FIG. 8 (PRIOR ART)
FIG. 8 illustrates a conventional screed device.
Figure 9:
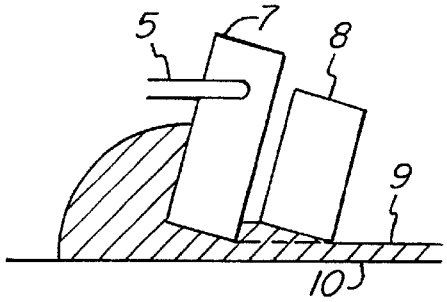
FIG. 9 (PRIOR ART)
FIG. 9 is a view illustrating a state where a step is occurring between the main screed and the extensible screed.
Figure 10:
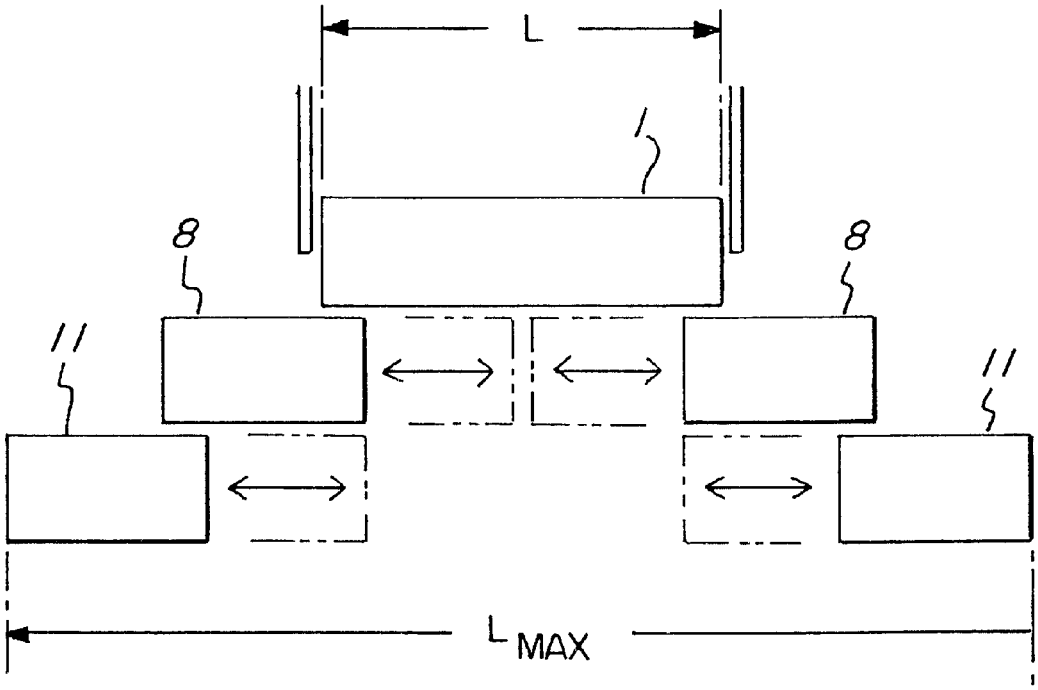
FIG. 10 (PRIOR ART)
FIG. 10 illustrates another conventional screed.
Figure 11:
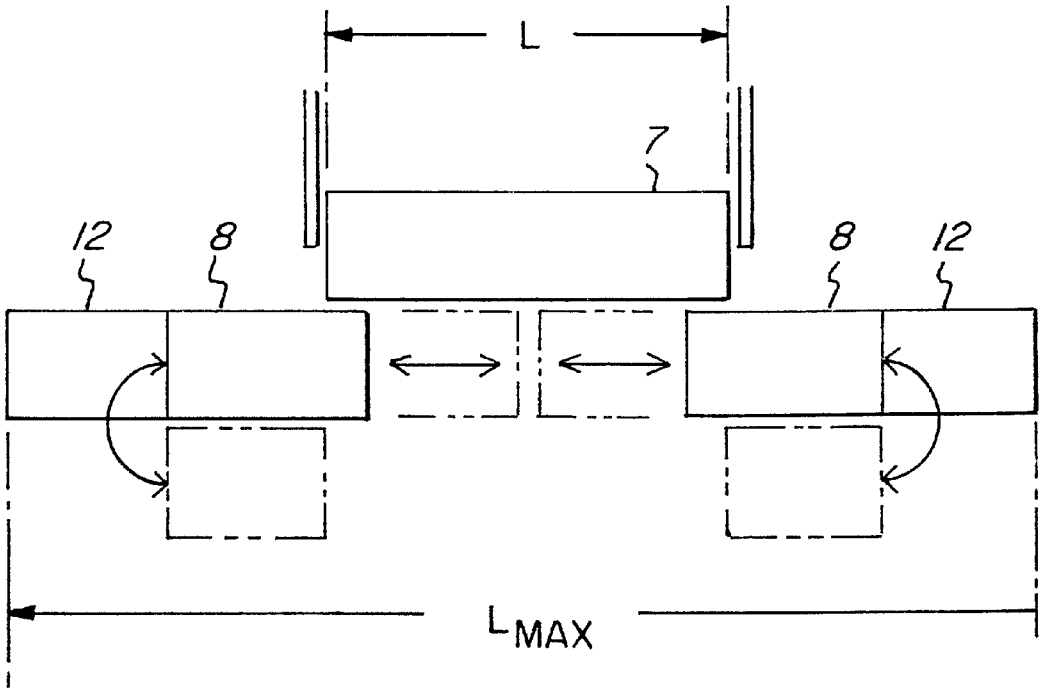
FIG. 11 (PRIOR ART)
FIG. 11 illustrates a further conventional screed.
Figure 12:
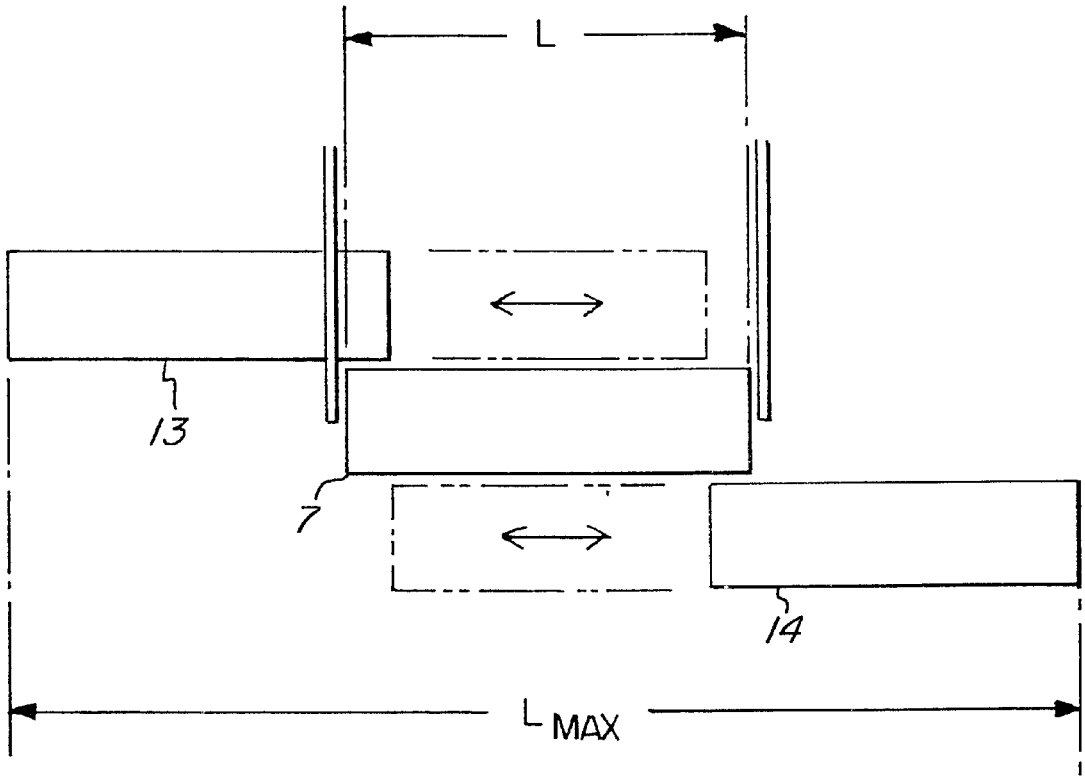
FIG. 12 (PRIOR ART)
FIG. 12 illustrates a still further conventional screed.
Figure 13:
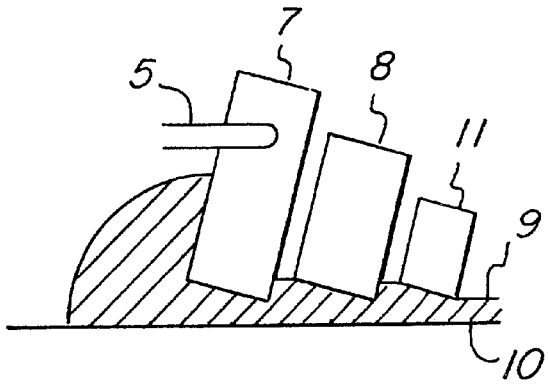
FIG. 13 (PRIOR ART)
FIG. 13 illustrates a state where steps are occurring in the conventional screed.

Referring to FIG. 7, further, extension screeds 12 are rotatably attached to the outer ends of the extensible screeds 15 and 16 to extend the range of pavement to be not less than three times (Lmax) of the width L of the main screed.

Figure 1B:
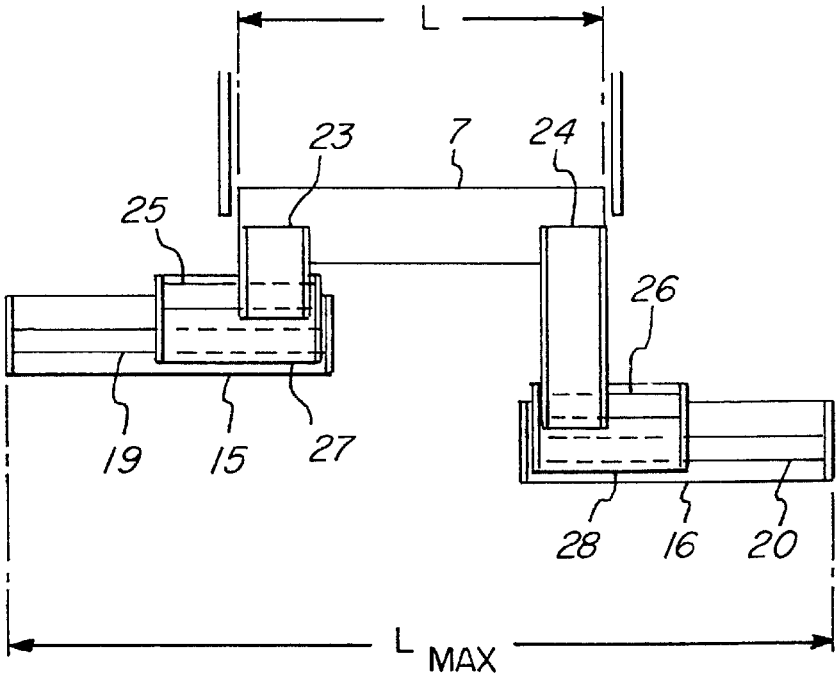

(1) According to an embodiment illustrated in FIGS. 1*a* and 1*b*, the width of pavement can be steplessly changed up to about three times the width of the main screed 7 through a simple operation.

(2) The constitution of an embodiment illustrated in FIG. 2 enables the width for supporting the guide shafts to be broadened. This makes it possible to obtain a high rigidity, to prevent both ends of the extensible screeds from jumping up over the paved surface due to the reaction during the execution of works, and to uniformalize the thickness of pavement in the direction of width.

(3) According to an embodiment illustrated in FIG. 3, the steps are adjusted only at two places.

(4) According to an embodiment illustrated in FIG. 4, the holding amount of the composite material does not change in front of the main screed 7 irrespective of the amount of extension or contraction of the extensible screeds. Therefore, paving angle of the screed device changes little, and the pavement is executed maintaining a constant thickness.

(5) According to an embodiment illustrated in FIG. 5, the composite material is placed in an amount necessary for the pavement in front of the extensible screeds due to the extensible molding boards, and the holding amount of the composite material decreases in front of the extensible screeds. Therefore, a large driving force (engine power) is not required, and fuel is consumed in a decreased amount.

Further, the composite material does not stay and needs not be wastefully discarded.

Further, since no "dragging hole" is formed, the paved surface needs not be repaired reducing burden for the workers.

(6) According to an embodiment illustrated in FIG. 6, the resistance due to the holding amount of the composite material is nearly the same on the right side and the left side, enabling the asphalt finisher to proceed straight.

(7) According to an embodiment illustrated in FIG. 7, the width of pavement can be broadened to not less than three times the width of the main screed 7.

What is claimed is:

1. A screed device in a road-paving vehicle comprising:

a main screed (7) having a width;

a pair of extensible screeds (15, 16) having a width nearly equal to the width of said main screed (7) and arranged to move back and forth in the direction of the width at the back of the main screed in the direction of progress;

screed supports (23, 24) supporting each of said pair of extensible screeds;

extension supports (27, 28), said extension supports are allowed to move in the direction of width of pavement on said screed supports (23, 24) provided on both sides at upper rear portions of said main screed (7);

each of said pair of extensible screeds (15, 16) are supported by said extension supports (27, 28) so as to be freely moved in the direction of width of pavement; and extending devices, each of said pair of extensible screeds (15, 16) are moved by one of said extending devices in the directions of width of pavement but opposite to each other from rear positions of said main screed (7).

2. A screed device in a road-paving vehicle according to claim 1, wherein the screed supports (23, 24) are supported to move up and down with respect to the main screed (7) by a hoist means to adjust said pair of extensible screeds (15, 16) that are movable in the direction of width of pavement.

3. A screed device in a road-paving vehicle according to claim 1, wherein said pair of extensible screeds (15, 16) are divided into upper frames **(15*a*, 16*a*) and lower frames (15*b*, 16*b*), and the lower frames (15*b*, 16*b*) are caused by hoist means (30) to move up and down relative to the upper frames (15*a*, 16*a*) that move in the direction of pavement thereby to adjust said pair of extensible screeds (15 and 16)**.

4. A screed device in a road-paving vehicle according to claim 1 wherein a rear one of said pair of extensible screeds is rearwardly of the other one of said pair of extensible screeds, further comprising an extensible molding board (32) coupled at its one end to a side arm (31) extending forward in the direction of progress from an outer end of the rear one of said pair of extensible screeds (15), is supported by a guide (33) provided on the rear surface of the main screed (7) so as to freely move in the direction of width of pavement along a surface nearly the same as the rear surface of the main screed (7), thereby to adjust the height of the lower end of the extensible molding board (32), so that composite material is placed in an amount required for the pavement in front of the rear one of said pair of extensible screeds (15).

5. A screed device in a road-paving vehicle according to claim 1, wherein extensible molding boards (36, 37) coupled at their ends on one side to side arms (34, 35) extending forward in the direction of progress from the outer ends of the front and rear ones of said pair of extensible screeds (15,16), are supported by a pair of guides (38, 39) provided on the front surface of the main screed (7) so as to freely move in the direction of width of pavement along a surface nearly the same as the front surface of the main screed (7), thereby to adjust the heights of the lower ends of the extensible molding boards (36, 37), so that composite materials are placed in amounts required for the pavement in front of the front and rear ones of said pair of extensible screeds (15, 16).

6. A screed device in a road-paving vehicle according to claim 1, wherein one or more pairs of extension screeds (11) are provided at the back or in front of said pair of extensible screeds (15, 16), and are moved by the extending devices such as hydraulic cylinders in the directions of width of pavement but opposite to each other from the rear positions or front positions of said pair of extensible screeds (15, 16).

7. A screed device in a road-paving vehicle according to claim 1, wherein extension screeds (12) are attached to the outer ends of front and rear ones of said pair of extensible screeds (25, 16) to further extend the range.

8. A screed device for use with a road-paving vehicle comprising:

a main screed having a main length and a first and second end;

a first screed support provided on the first end of said main screed;

a second screed support provided on the second end of said main screed;

a first extension support supported by said first screed support, said first extension support allowed to move in the direction of the main length of said main screed a first screed support distance;

a second extension support supported by said second screed support, said second extension support allowed to move in the direction of the main length of said main screed a second screed support distance;

a first screed having a first length supported by said first extension support and positioned rearward of said main screed, said first screed allowed to move in the direction of the main length of said main screed a first extension support distance, the first length of said first screed being substantially equal to the main length of said main screed;

a second screed having a second length supported by said second extension support and positioned rearward of said first screed, said second screed allowed to move in the direction of the main length of said main screed a second extension support distance, the second length of said second screed being substantially equal to the main length of said main screed; and an extending device coupled to said first and second screed moving said first and second screed in the direction of the main length, whereby the screed device is capable of being rigidly extended to an extended pavement width.

9. A screed device for use with a road-paving vehicle as in claim 8 further comprising:

a hoist coupled to said first and second screed supports, whereby said first and second screeds are capable of being moved up and down relative to said main screed.

10. A screed device for use with a road-paving vehicle as in claim 8 wherein:

said first and second screeds comprise an upper frame and a lower frame, wherein the lower frame is capable of being moved up and down relative to the upper frame.

11. A screed device for use with a road-paving vehicle as in claim 8 further comprising:

a molding board extending the second length of said second screed and placed forward thereof in line with a rear surface of said main screed, whereby a paving material is placed in an amount required for paving forward of said second screed.

12. A screed device for use with a road-paving vehicle as in claim 8 further comprising:

a first molding board extending the first length of said first screed and placed forward thereof in line with a front surface of said main screed, whereby a paving material is placed in an amount required for paving forward of said first screed; and a second molding board extending the second length of said second screed and placed forward thereof in line with the front surface of said main screed, whereby the paving material is placed in an amount required for paving forward of said second screed.

13. A screed device for use with a road-paving vehicle as in claim 8 further comprising:

an extension screed provided on said first and second screeds movable in the direction of the main length.

14. A screed device for use with a road-paving vehicle as in claim 8 further comprising:

extension screeds attached to outer ends of said first and second screeds.

15. A screed device for use with a road-paving vehicle comprising:

a main screed having a main length and a first and second end;

a first screed support provided on the first end of said main screed;

a second screed support provided on the second end of said main screed;

a first extension support supported by said first screed support, said first extension support allowed to move in the direction of the main length of said main screed a first screed support distance, the first screed support distance being less than the main length;

a second extension support supported by said second screed support, said second extension support allowed to move in the direction of the main length of said main screed a second screed support distance, the second screed support distance being less than the main length;

a first screed having a first length supported by said first extension support and positioned rearward of said main screed, said first screed allowed to move in the direction of the main length of said main screed a first extension support distance, the first extension support distance being less than the main length, and the first length of said first screed being substantially equal to the main length of said main screed;

a second screed having a second length supported by said second extension support and positioned rearward of said first screed, said second screed allowed to move in the direction of the main length of said main screed a second extension support distance, the second extension support distance being less than the main length, and the second length of said second screed being substantially equal to the main length of said main screed;

a hydraulic extending device coupled to said first and second screed capable of moving said first and second screed in the direction of the main length;

a hoist coupled to said first and second screed supports, whereby said first and second screeds are capable of being moved up and down relative to said main screed;

a first molding board extending the first length of said first screed and placed forward thereof in line with a front surface of said main screed, whereby a paving material is placed in an amount required for paving forward of said first screed; and a second molding board extending the second length of said second screed and placed forward thereof in line with the front surface of said main screed, whereby the paving material is placed in an amount required for paving forward of said second screed, whereby the screed device is capable of being rigidly extended to an extended pavement width and resistance due to the holding amount of the paving material is the same in front of said first and second screeds.

16. A screed device for paving a road comprising:

a main screed having a first and second end;

a first screed support positioned at the first end;

a second screed support positioned at the second end;

a first extension support mounted on said first screed support, said first extension support capable of moving laterally on said first screed support;

a first extensible screed mounted on said first extension support, said first extensible screed capable of moving laterally and positioned rearward of said main screed;

a second extension support mounted on said second screed support, said second extension support capable of moving laterally on said first screed support; and a second extensible screed mounted on said second extension support, said second extensible screed capable of moving laterally and positioned rearward of said first extensible screed, whereby said first and second extensible screeds are rearwardly and forwardly offset and capable of overlapping when unextended so that the screed device is capable of being rigidly extended to an extended pavement width.

* * * * *